US005409375A

United States Patent [19]

Butcher

[11] Patent Number: 5,409,375

[45] Date of Patent: Apr. 25, 1995

[54] RADIANT BURNER

[75] Inventor: Kenneth R. Butcher, Hendersonville, N.C.

[73] Assignee: SELEE Corporation, Hendersonville, N.C.

[21] Appl. No.: 165,945

[22] Filed: Dec. 10, 1993

[51] Int. Cl.[6] ..... F23D 14/12

[52] U.S. Cl. ..... 431/328

[58] Field of Search ..... 431/328, 329

[56] References Cited

U.S. PATENT DOCUMENTS

| | | | |
|---|---|---|---|
| 3,912,443 | 10/1975 | Ravault et al. . | |
| 3,954,388 | 5/1976 | Hildebrand . | |
| 4,220,132 | 9/1980 | Streisel . | |
| 4,375,214 | 3/1983 | Wysong . | |
| 4,416,619 | 11/1983 | Craig et al. | 431/328 |
| 4,504,218 | 3/1985 | Mihara et al. | 431/328 |
| 4,508,502 | 4/1985 | Itoh | 431/328 |
| 4,533,318 | 8/1985 | Buehl . | |
| 4,643,667 | 2/1987 | Fleming . | |
| 4,869,664 | 9/1989 | Wright et al. . | |
| 5,088,919 | 2/1992 | De Bruyne et al. | 431/328 |

FOREIGN PATENT DOCUMENTS

| | | |
|---|---|---|
| 1019807 | 2/1966 | United Kingdom . |
| 1377691 | 12/1974 | United Kingdom . |
| 1412142 | 10/1975 | United Kingdom . |
| 1419762 | 12/1975 | United Kingdom . |
| 1419763 | 12/1975 | United Kingdom . |

*Primary Examiner*—Carroll B. Dority
*Attorney, Agent, or Firm*—Carter & Schnedler

[57] ABSTRACT

There is provided an improved radiant burner formed from a reticulated ceramic substrate. The porosity of the substrate is such as to permit combustible gas to pass therethrough. The substrate includes a plurality of intersecting grooves extending into one of its surfaces, thereby substantially eliminating cold spots on the radiant burner.

11 Claims, 1 Drawing Sheet

RADIANT BURNER

BACKGROUND OF THE INVENTION

This invention relates to gas fired radiant burners. More particularly it relates to gas fired radiant burners made of ceramic materials.

Heat energy is normally transmitted by conduction, convection, or radiation. In many applications it is desirable to utilize radiation as the primary means for transmitting heat. Radiant energy is not affected by the movement of air, may be directionally controlled and focused, and the intensity may be readily controlled, thereby enabling higher efficiencies than convection or conduction transmissions.

It is also often desirable to utilize natural gas as an energy source for producing heat. Natural gas is abundant and is one of the most environmentally clean sources of energy. Natural gas fired infrared heat generators are often referred to as radiant burners. These radiant burners generally include radiant burner plates or radiant burner tubes which are porous so as to permit the gas to pass therethrough. Natural gas and air are mixed in a plenum which is connected to the radiant burner plate or tube. In some cases the combustion mixture of air and gas is conveyed through holes in the burner plate and the gas burns above the surface of the plate. In that case the surface is heated by conduction from the close proximity of the flame. In other cases, the flame occurs below the surface of the plate which is heated directly by the gas flame. In other cases the heating of the plate occurs both at the surface and within the porous structure so that there is a combination of conductive heating and direct flame heating of the plate. Often the plate is made of a ceramic material.

A typical commercially available porous ceramic type radiant burner assembly 10 is shown in FIG. 1. A plenum 12 receives an air and gas mixture through orifice 14. A solid ceramic plate 16 forms the top of the burner assembly 10. Burner plate 16 includes a plurality of holes 18 which communicate with the inside of the plenum 12. The gas passes through the holes 18 and is ignited at the surface 20 of burner plate 16. The surface 20 of burner plate 16 is somewhat of a wavy construction so that there are alternate peaks and valleys. This type of burner plate is referred to as a ported tile.

There are also gas fired radiant burner plates made of reticulated ceramic foam such as that described in U.S. Pat. Nos. 3,912,443. 4,643,667 also teaches the use of a ceramic porous plate, which appears: to be foam, as a gas fired radiant burner. It has been found that the use of reticulated ceramic foam has many advantages over the ported tiles shown in FIG. 1. The primary advantage is that the foam is a more efficient radiating surface so that more heat is absorbed from the flame and converted into radiant energy as evidenced by the higher surface temperature of the foam. It is believed that this occurs primarily because the reticulated materials have substantially more surface area than the ported tile.

One of the primary problems with the use of ceramic foams is that the temperature of the surface tends to be uneven. The flame should burn just under the top (radiating) surface of the foam so that the heat is transferred both to the surface of the foam by conduction as well as by direct contact with the flame. If some of the pores are blocked, the air/gas mixture does not reach that particular portion of the surface and cold spots are the result. If the pores in the foam structure are too open or if the pores are too small, the flame will burn off the surface again resulting in a cold spot because of insufficient conduction at that position on the surface of the plate.

There have been attempts to solve this problem by laminating foams of two different pore sizes together. This technique is taught in both U.S. Pat. Nos. 3,912,443 and 4,643,667 which are referred to above. Generally, the bottom layer is made of a fine pore foam, for example 30 to 100 pores per inch, and the top layer is made of a coarser foam, for example from 5 to 20 pores per inch. This causes the flame to burn at the surface of the fine foam but within the layer of the coarse foam so that the coarse foam, which is the radiant burner plate, is heated directly by the flame rather than by conduction. However this multi-layer construction is very difficult to control and will often result in cold spots on the surface of the radiant burner.

OBJECTS OF THE INVENTION

It is therefore one object of this invention to provide an improved gas fired radiant burner.

It is another object to provide a radiant burner having a radiating surface which radiates heat substantially evenly.

It is yet another object to provide a radiant burner made of a reticulated ceramic material which radiates substantially evenly.

SUMMARY OF THE INVENTION

In accordance with one form of this invention there is provided a radiant burner including a reticulated ceramic substrate. The porosity of the substrate permits a combustible gas to pass therethrough. The substrate includes first and second major surfaces. The first major surface is adapted to have initial contact with the gas. The second major surface is adapted to radiate after the gas has been ignited. A plurality of grooves are received in the substrate on the second surface whereby the second surface will radiate substantially evenly.

It is preferred that there are first and second sets of grooves with the first set of grooves intersecting with the second set of grooves at substantially evenly spaced intervals.

The ceramic used to manufacture the substrate may be various materials including alumina, mullite, zirconia, cordierite and other refractory materials. A ceramic slurry is normally applied to an organic foam for manufacturing the substrate. The grooves may be formed either before or after the ceramic slurry is applied to the organic foam or after the slurry has been fired.

In accordance with another form of this invention, there is provided a method for producing a radiant burner. A piece of polyurethane foam in the shape of a parallelpiped is cut. A plurality of spaced apart grooves are cut in the polyurethane foam. A ceramic slurry is formed. The polyurethane foam is impregnated with the ceramic slurry. The slurry is dried and the impregnated polyurethane foam is fired.

In accordance with another form of this invention, there is provided a method for forming a radiant burner. A piece of polyurethane foam in the shape of a parallelpiped is cut. A ceramic slurry is formed. The polyurethane foam is impregnated with ceramic slurry. The slurry is dried and the impregnated polyurethane foam is fired, thereby forming a reticulated ceramic substrate.

A plurality of spaced apart parallel grooves are cut in one surface of the reticulated ceramic substrate.

BRIEF DESCRIPTION OF THE DRAWINGS

The subject matter which is regarded as the invention is set forth in the appended claims. The invention itself, however, together with further objects and advantages thereof may be better understood by reference to the following description taken in conjunction with the accompanying drawings in which:

DESCRIPTION OF THE PREFERRED EMBODIMENT

Figure 2:
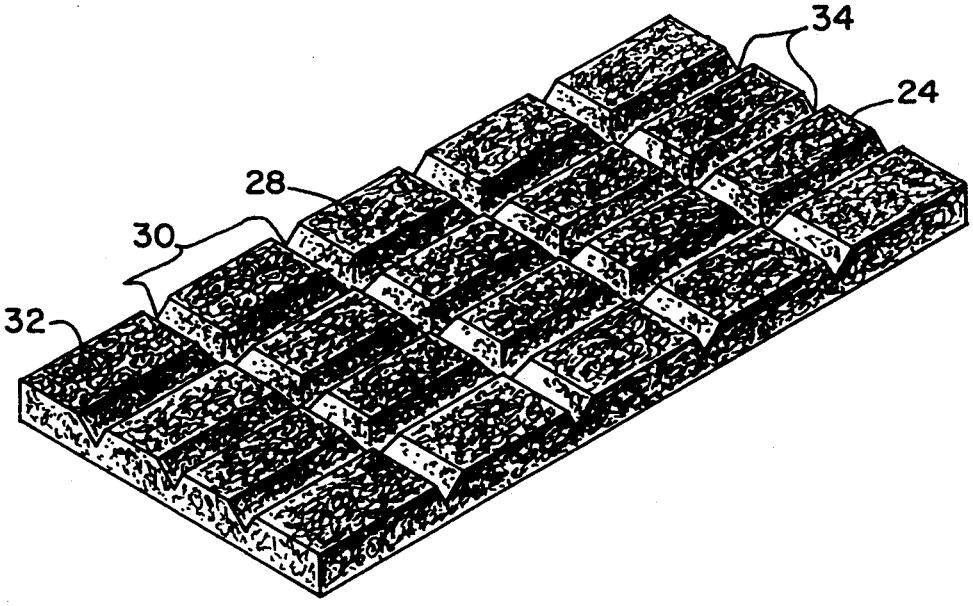
FIG. 2 is a pictorial view of one embodiment of the radiant burner of the subject invention in the form of a plate.
Figure 3:
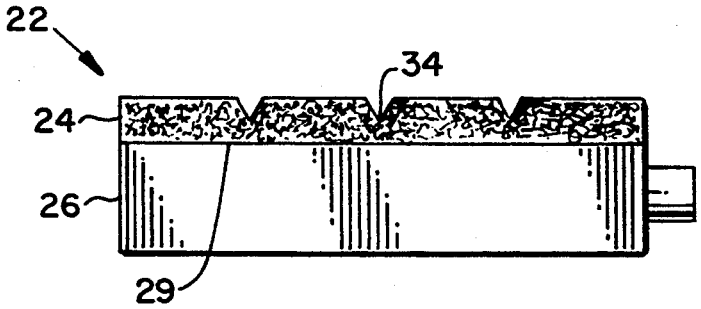
FIG. 3 is a side elevational view of the radiant burner plate of FIG. 2 which is connected to a typical plenum.

Referring now more particularly to FIGS. 2 and 3, there is provided radiant burner assembly 22 including radiant burner plate 24 which is in the form of a substrate made of a reticulated ceramic foam. Radiant burner assembly 22 includes plenum 26. Radiant burner plate 24 forms a sealed top for plenum 26. Substrate 24 is a parallel piped in shape and is an open pore structure having a network of individual pores 28 which are interconnected by window-like apertures. Each pore 28 within substrate 24 is surrounded by adjacent pores creating windows or openings between adjacent pores. The pores 28 permit combustible gas to pass through the substrate. The preferred gas is natural gas (a mixture of methane and hydrogen), however other gases such as propane may be used.

The ceramic foam may be made of various materials including alumina, zirconia, mullite, cordierite, silicon carbide, and other refractory materials. Reticulated ceramic foam is known to those skilled in the art primarily as a molten metal filter and may be formed using known techniques such as those techniques described in U.S. Pat. No. 4,024,212 assigned to Swiss Aluminum, Ltd.

Substrate 24 includes a first major surface 29, which makes initial contact with the gas, and second major surface 32, which is the top surface and which radiates after the gas is ignited. Substrate 24 includes a first set of parallel spaced apart grooves 30 extending into top surface 32. For convenience sake, this first set of grooves are referred to as vertical grooves. In addition there is a second set of spaced apart parallel grooves 34 which are identical in structure to the vertical groove 30 and which, for convenience sake, will be referred to as horizontal grooves. The horizontal grooves and the vertical grooves intersect with one another forming an orthaginal grid. The center to center spacing between adjacent parallel grooves may be between $\frac{1}{8}$" and 2" although preferably the spacing is approximately $\frac{1}{4}$". The depth of each groove may vary between 1/100" and $\frac{1}{2}$". The depth of each groove on a particular substrate should be identical for even heat output on the surface. The width of the grooves at top surface 32 may vary between 0.5 millimeters and 10 millimeters. The porosity of the substrate is preferably between 10 pores per inch and 100 pores per inch.

Another means for expressing porosity is in terms of a comparison of the density of a solid block of ceramic material to reticulated material. The density of the reticulated material should be between 10% and 25% of the density of a solid block of the material. The thickness of the substrate 24 is preferably between $\frac{1}{8}$" and 3".

Figure 1:
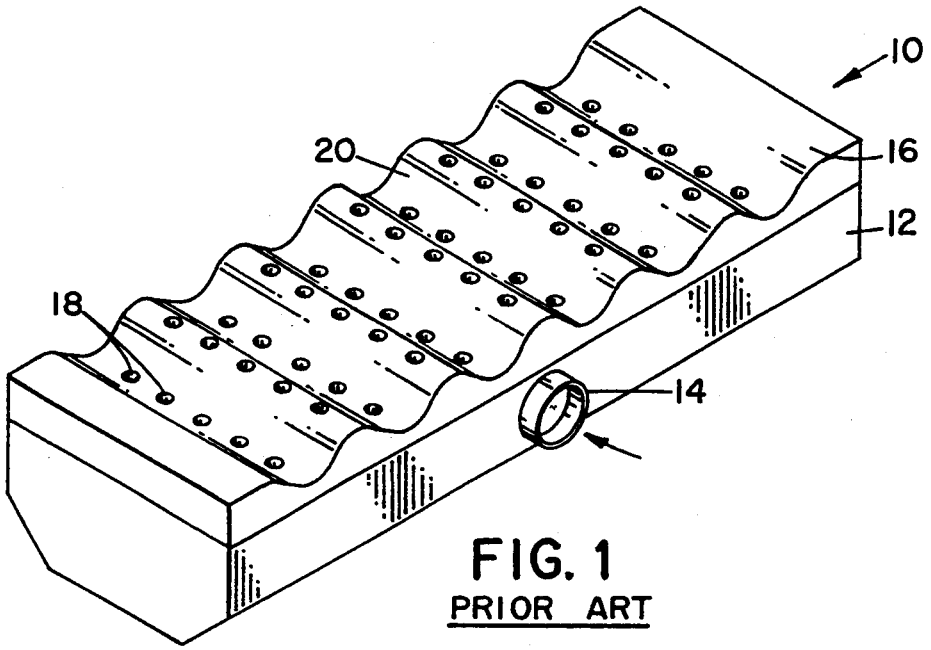
FIG. 1 PRIOR ART
FIG. 1 is a pictorial view of a typical prior art ported tile radiant burner which is attached to a plenum.

By utilizing the radiant burner plate of reticulated ceramic material having the intersecting grooves 30 and 34 therein, it has been found that the cold spots which occur in the prior art burner ceramic foam plate have been substantially eliminated. It is believed that a substantial amount of combustion takes place within the grooves 30 and 34 thereby enabling a uniform heat transfer within the grid which is formed by the grooves. In addition, due to the large surface area of the reticulated material, it is believed that the efficiency of the radiant burner is higher than the partial tile burner shown in FIG. 1. The grooves 30 and 34 are preferably V-shaped. It is believed that in most instances V-shaped grooves produce a more stable burner.

The following examples serve to illustrate the invention.

Example 1

V-shaped intersecting grooves were cut into a piece of polyurethane foam thereby forming an orthaginal grid of the vertical and horizontal grooves. The spacing between adjacent grooves was about $\frac{1}{4}$" and the grooves were approximately 0.05" in width. In general the groove depth was approximately 0.125". The dimensions of the foam was approximately 6" by 3" by $\frac{1}{2}$". A second piece of polyurethane foam having approximately the same dimensions was also used, however no grooves were formed in the second piece of foam. A mullite slurry was prepared according to the following composition:

| | |
|---|---|
| $Al_2O_3$ | 49.2% |
| $SiO_2$ | 31.6% |
| $Na_2O + K_2O + FE_2O_3$ | 1.2% |
| $H_2O$ | 16.4% |
| Organic Binders | 1.6% |

Both the grooved and ungrooved foam were impregnated with the mullite slurry. Both pieces of impregnated foam were dried and fired in accordance with known procedures described in U.S. Pat. No. 4,024,212. Both the grooved and ungrooved foams were then placed on substantially identical plenums which were fed with substantially identical gas and air mixtures at substantially identical pressures and both were ignited. After approximately 45 minutes, the resulting burners, began to glow. The burner made from the ungrooved foam exhibited several dark areas. One of the dark areas was approximately circular in shape and about 1" in diameter. Another dark area was in the form of a band across the burner approximately 1" wide. The grooved burner, however, exhibited a much more homogenous glow. The center of each square formed by the intersecting grooves did not glow quite as brightly as the other parts although this was uniform throughout the surface. It was apparent that the flames were burning in the grooves causing the surrounding foam to glow brightly. The only dark portion was a very small area approximately $\frac{1}{2}$" in diameter in a place where the groove depth was substantially less than the depth of the remaining grooves, i.e. that portion was measured to be approximately only 0.02" in depth.

Example 2

An ungrooved ceramic foam plate was formed as in Example 1. After the ceramic was fired, V-shaped grooves were cut in the ceramic foam with a diamond saw. In this example the spacing between adjacent grooves was about ½" and the depth of the grooves was 0.125" and their width was also 0.125". In this example because the grooves were cut after firing the grooves were more uniform in dimension. The burner was ignited and no dark places were seen on the burner.

Example 3

Sample A was constructed in accordance with Example 1, however no grooves were formed. Sample B was formed in accordance with Example 1 with the grooves as described in Example 1. Sample C was formed in accordance with Example 2. Each of the samples was placed on a plenum and the gas was ignited. The samples glowed after about 45 seconds. An optical pyrometer was used to measure the temperature at various positions on the samples as set forth below:

| | | |
|---|---|---|
| Sample A: | Dark areas | 1100° F. |
| | Bright areas | 1550° F. |
| Sample B: | Grooves | 1600° F. |
| | Centers | 1450° F. |
| Sample C: | Grooves | 1600° F. |
| | Centers | 1500° F. |

The centers referred to above are defined as the centers of each square formed by the intersecting grooves.

Thus a highly efficient radiant burner is provided having a very large surface area for the absorption and radiation of heat which overcomes the cold spot problems which occurred when using reticulated ceramic foam as the burner plate.

It will be obvious to those skilled in the art that various modifications may be made in this invention without departing from the spirit and scope thereof and therefore the invention is not intended to be limited to the embodiment described in the specification set forth above. It is intended in the accompanying claims to cover all such modifications.

I claim:

1. A radiant burner comprising:

a reticulated ceramic substrate; said substrate having a porosity so as to permit combustible gas to pass therethrough; said substrate having first and second major surfaces; said first surface adapted to be in initial contact with the gas; said second surface adapted to radiate after the gas has been ignited;

a plurality of grooves received in said substrate on said second surface; said grooves including a first set of grooves and a second set of grooves; said first set of grooves being parallel and spaced apart from one another and said second set of grooves being parallel and spaced apart from one another; said second set of grooves intersecting with said first set of grooves; said grooves are substantially V-shaped; the depth of said grooves being between 0.125" and 0.5";

the density of said reticulated ceramic substrate is between 10% and 25% of the density of a solid ceramic block of the same outer dimensions.

2. A burner as set forth in claim 1 wherein the spacing between adjacent parallel grooves is between ¼" and 2".

3. A burner as set forth in claim 1 wherein the width of said grooves is between 0.5 millimeters and 10 millimeters.

4. A burner as set forth in claim 1 wherein the pore density of said substrate is between 15 pores per inch and 100 pores per inch.

5. A burner as set forth in claim 1 wherein the thickness of said substrate is between ¼" and 3".

6. A burner as set forth in claim 1 further including a plenum; said substrate attached to said plenum; said first surface of said substrate facing the inside of said plenum.

7. A burner as set forth in claim 1 wherein said ceramic substrate is made from refractory material.

8. A burner as set forth in claim 6 wherein said refractory material is taken from the group consisting of alumina, mullite, zirconia and cordierite.

9. A radiant burner comprising:

a reticulated ceramic plate; said plate having a pore density between 10 pores per inch and 100 pores per inch so as to permit combustible gas to pass therethrough; said substrate having first and second major surfaces; said first major surface adapted to have initial contact with the combustible gas; said second major surface adapted to radiate after said gas has been ignited;

a first set of spaced apart parallel grooves extending into said second surface; a second set of spaced apart parallel grooves extending into said second surface; said first set of grooves intersecting with said second set of grooves; said grooves being at least 0.125" deep; adjacent parallel grooves being spaced apart no more than 2"; said grooves being substantially V-shaped;

the density of said reticulated ceramic plate is between 10% and 25% of the density of a solid ceramic block of the same outer dimensions.

10. A method for producing a radiant burner comprising the steps of:

cutting a piece of polyurethane foam in the desired shape;

cutting a plurality of spaced apart grooves in said polyurethane foam;

forming a ceramic slurry;

impregnating said polyurethane foam with said ceramic slurry;

drying said slurry;

firing said impregnated polyurethane foam thereby forming a reticulated ceramic radiant burner;

said grooves including a first set of grooves and a second set of grooves; said first set of grooves being parallel and spaced apart from one another; said second set of grooves being parallel and spaced apart from one another; said second set of grooves intersecting with said first set of grooves; said grooves being substantially V-shaped; the depth of said grooves is between 0.125" and 0.5";

the density of said radiant burner being between 10% and 25% of the density of a solid ceramic block of the same outer dimensions.

11. A method for forming a radiant burner comprising the steps of:

cutting a piece of polyurethane foam in the desired shape;

preparing a ceramic slurry;

impregnating said polyurethane foam with said ceramic slurry;

drying said slurry;

firing said impregnated polyurethane foam thereby forming a reticulated ceramic substrate;

cutting a plurality of spaced apart parallel grooves in one surface of said reticulated ceramic substrate; said grooves including a first set of grooves and a second set of grooves; said first set of grooves being parallel and spaced apart from one another; said second set of grooves being parallel and spaced apart from one another; said second set of grooves intersecting with said first set of grooves; said grooves being substantially V-shaped; the depth of said grooves being between 0.125" and 0.5";

the density of said reticulated ceramic substrate being between 10% and 25% of the density of a solid ceramic block of the same outer dimension.

* * * * *